US005911595A

United States Patent [19]

Orr, Jr. et al.

[11] Patent Number: 5,911,595

[45] Date of Patent: Jun. 15, 1999

[54] LOW PROFILE ANGULAR CONNECTOR DEVICE AND METHOD

[75] Inventors: Lawrence William Orr, Jr., Simpsonville, S.C.; Roland A. Kern; Richard John Kern, both of Lake Forest, Calif.

[73] Assignees: Kern Engineering & Mfg. Co., Fullerton, Calif.; Woven Electronics Corp, Simpsonville, S.C.

[21] Appl. No.: 08/681,798

[22] Filed: Jul. 29, 1996

[51] Int. Cl.[6] ..... H01R 13/58

[52] U.S. Cl. ..... 439/471; 439/902

[58] Field of Search ..... 439/902, 598, 439/903, 470, 640

[56] References Cited

U.S. PATENT DOCUMENTS

| | | | |
|---|---|---|---|
| 367,734 | 8/1887 | Widdicombe . | |
| 2,374,971 | 5/1945 | Benander | 439/902 |
| 3,555,493 | 1/1971 | Baumanis | 339/176 |
| 3,675,184 | 7/1972 | Vetter | 439/902 |
| 3,951,490 | 4/1976 | Devendorf | 339/17 C |
| 4,224,485 | 9/1980 | Krumreich | 200/51.1 |
| 4,585,292 | 4/1986 | Frantz et al. | 339/143 R |
| 4,767,355 | 8/1988 | Phillipson et al. | 439/425 |
| 4,804,343 | 2/1989 | Reedy | 439/854 |
| 5,277,617 | 1/1994 | Shasteen | 439/465 |

OTHER PUBLICATIONS

ITT Cannon Catalogue pp. 214, 215, 224, 225.

*Primary Examiner*—Neil Abrams
*Assistant Examiner*—Eugene G. Byrd
*Attorney, Agent, or Firm*—Robert R. Reed; Cort Flint

[57] ABSTRACT

The electrical connector of this invention is for terminating the wires of a cable into an electrical insert positioned within a connector backshell at an angle to the direction of the cable. A wireing space at the rear of the backshell is provided to terminate the wires within the insert. The connector is used to provide a connector interface for a cable running along one surface of a bulkhead and turning at an angle through the bulkhead to a receptacle or connector face extending from the other face of the bulkhead. The connector face receives an associated electrical interface device. The electrical connector of this invention provides the connector in a minimum amount of clearance space on both sides of the bulkhead. Grounding and shielding of a shielded portion of the cable to the connector is also provided within the minimum clearance space. A tie cord attaches the wires of the cable to a neck of the hollow shaft of the connector backshell to provide stress relief for the wires.

40 Claims, 4 Drawing Sheets

LOW PROFILE ANGULAR CONNECTOR DEVICE AND METHOD

BACKGROUND OF THE INVENTION

This invention relates to electrical connectors for terminating wires of a high speed electrical transmission cable, and more particularly to terminating wires at an angle in a minimum clearance space for military electrical transmission systems and other applications.

In many applications of electrical connectors for terminating an electrical cable, the wires are required to be terminated and connected to an associated electrical interface device in a minimum amount of clearance space. This requirement is made more difficult by the necessity to terminate wires at an angle to the direction of a circular cable. This requirement is typical to an application where a cable is running along a wall or bulkhead and the wires are terminated in a connector interface extending through the wall. In particular, the electrical connector must be aligned with the wall so that an associated electrical connector or interface device can be plugged into the connector in a direction normal to the surface of the wall. The associated connector device may also have a generally circular array of terminals.

A number of connector devices are known in the industry for providing termination of wires where the clearance space is not limited; or turning the wires through an angle is not a requirement. Typical connectors are the MIL-C-5015 type firewall connector or the CA Bayonet connector as manufactured by ITT Cannon of Santa Anna, Calif. (see pages 211, 215 and 224 of the 1993–94 ITT Cannon Source Book accompanying the application). These connectors require adequate clearance space from a firewall or bulkhead and generally do not provide for an angle change of the wires. A connector providing for a 90 degree angle change in the direction of the wires is illustrated as Part No. CA 3108 E-B/-01/-F80 on page 225 of the ITT Cannon Source Book. A large clearance space is required for this connector to make the 90 degree angle change, making it unsuitable for many applications.

Previous electrical connectors generally include a housing or body for providing a wiring space to terminate wires of a cable. The housings limit the ability for routing and turning the wires in a minimum clearance space. The attachment of a cable to the housings is further limited in its ability to provide strain relief, shielding and grounding of the cable.

The termination of wires of a cable within a housing or box is disclosed in U.S. Pat. Nos. 367,734; 3,951,490; 4,224,485; 4,804,343; and 5,277,617. The U.S. Pat. No. 367,734 patent discloses terminating telegraph cables in an air tight metallic box having a removable back. Wires enter through a nipple and are terminated on binding posts extending through the box. Binding posts are provide so that wires are generally terminated without being turned inside the box.

In U.S. Pat. No. 3,951,490 a substation for distributing signals includes a number of ports for cables to enter a housing and terminate on a circuit board. Terminals extend to the exterior of the housing to terminate in coupling ports. In the telephone jack of U.S. Pat. No. 4,224,485, a plurality of wires terminated in a carrier at a right angle from the wires entering an opening of the carrier. The dust cover helps protect the wires, but the wires do not attach to the dust cover. These patents disclose additional connector parts so that wires are not turned to provide an angle change for attachment to the associated connector device.

The 90 degree lamp socket assembly disclosed in U.S. Pat. No. 4,804,343 includes a body having a tubular portion and a connector portion to receive a plurality of wire strands encased within a cable. The lamp socket clips into a panel portion to extend the lamp 90 degrees to the panel portion. Cavities in the body receive wire terminals and additional feed terminals turn the wire strands 90 degrees. A ring portion crimped over a cable seal mechanically connects the cable to the body and a cable lock retains the terminals within the socket body. Grounding in addition to strain relief of these cables is not required.

In the disclosure of U.S. Pat. No. 5,277,617 a flat cable is terminated at an angle within a housing section (FIG. 3). Strain relief for the cable is provided by an end walls and a back ridge in combination. The flat cable is resilient and able to make angular changes perpendicular to the plane of the cable with little effort. The same procedure is difficult for circular cables having a bundle of closely spaced wires.

The connection of cables to a housing or box for providing strain relief is disclosed in U.S. Pat. Nos. 3,555,493; 4,585,292; and 4,767,355. In U.S. Pat. No. 3,555,493 a right angle printed circuit board connector includes terminals attached to each lead-in wire having an upstanding leg to provide the 90 degree angle change. A separate terminal is provide for each wire for mounting within a housing. A crimp type connector is used for strain relief and securing a lead-in wire to the terminal of the connector.

In U.S. Pat. No. 4,585,292 a shielded connector includes a pair of metal shields forming a housing having a cable exit portion. A shield of a multiconductor cable is dressed over the outside of the cable exit portion and secured thereto by a crimp ring. The outer surfaces of the exit portions can have profiles, serrations and/or grooves to enhance gripping of the cable shield. The connector can be overmolded with an overmolding material. The cable wires enter the shields and terminate without an angle change. A similar connector device for terminating wires straight ahead is disclosed in U.S. Pat. No. 4,767,355. A jack adapted for connection to a printed circuit board is disclosed for a modular plug connector having a cord shield terminating contact. A conductive collar electrically engages a ferrule in electrical engagement with the cord shield and extends into a shield-terminating portion of a cavity of the modular plug connector. Each conductor is situated in an aligned relationship with a respective terminal receiving slot.

The prior art does not provide an electrical connector for high-speed electrical transmission cable systems; wherein the connector has a connector backshell with a housing for grounding the cable and terminating wires at an angle in a minimum clearance space. The problem is particularly troublesome for circular cables being terminated within a cylindrical insert.

Accordingly, an object of the present invention is to provide for termination of individual wires of a circular cable in a minimum amount of clearance space, while allowing an associated electrical interface device to connect at an angle to the direction of the cable.

Another object of the present invention is to have an electrical connector that provides for terminating a metallic shield portion of a cable for protecting the cable's environment from electromagnetic and radio frequency interferences.

Yet another object of the present invention is to provide a low-profile electrical connector for installing a cable parallel to a bulkhead and terminating wires of the cable through the bulkhead at a right angle to the plane of the bulkhead.

SUMMARY OF THE INVENTION

The above objectives are accomplished according to the present invention by providing a connector backshell having a hollow stem for receiving wires of a cable. Wires are terminated in an electrical insert within the connector backshell. The wires are shielded with a braided metallic cover grounded to the connector backshell to protect against electrical interferences. The insert is carried by the backshell at an angle to the direction of the cable in the hollow stem. The braided metallic cover for shielding the cable is terminated and grounded to a neck of the hollow stem.

In one embodiment of the invention an electrical connector is provided for terminating wires of an electrical cable in a minimum amount of clearance space for connecting to an associated electrical interface device. The electrical connector comprises a connector backshell having a cylindrical backshell insert housing with an open backshell face normal to an interface axis. A hollow stem included in the connector backshell for receiving the cable along a stem axis extending at an angle to the interface axis of the connector backshell. A cylindrical electrical insert is carried within the backshell housing and has a connector face generally coextending with the open backshell face. The insert has a plurality of electrical terminals or cavities for mating with the electrical interface device. A backshell access, open to the rear of the connector backshell, is for receiving the insert and for allowing the wires of the cable to be terminated within the electrical insert. A rear cover is for closing the rear backshell access to provide shielding for the wires within the backshell, so that a thickness of the connector backshell is minimized to accommodate connection to the associated electrical interface device in the minimum amount of clearance space.

In another embodiment of the invention a low-profile electrical connector assembly is provided for terminating wires of a shielded cable to an associated electrical interface device at an angle to the direction of the cable. The assembly comprises a connector backshell, having a cylindrical backshell housing with an interface axis at the angle, and an open backshell face perpendicular to the interface axis. An electrical connector insert is positioned within the backshell housing for providing a connector face generally coextending with the open backshell face, and having a plurality of sockets for terminating contacts associated with the wires. A backshell access is open to the rear of the backshell to accommodate the termination of the wires to the connector insert. The assembly further comprises a hollow stem of the backshell including a neck portion for receiving the cable along a stem axis extending at the angle to the interface axis. A coupling ring is for bringing a conductive sheathing metallic cover of the shielded cable into grounding contact with the neck portion and for providing a shielded attachment of the cable to the backshell. A rear access cover is affixed to the backshell for closing the rear backshell access to provide a shielded rear wiring space for the wires within the backshell. A mounting flange is affixing the backshell to an interface support. A low profile is defined between the mounting flange and the rear access cover as providing the rear wiring space to accommodate electrical connection of the wires to the connector insert in a minimum amount of clearance space.

In a further embodiment of the invention a method is provided for terminating a shielded electrical transmission cable to an electrical interface device in a minimum amount of clearance space. The method includes the following steps. A first step is providing a connector backshell having a cylindrical backshell housing with an interface axis, a hollow entrance stem for receiving the cable along a stem axis extending perpendicular to the interface axis and a rear backshell access for routing wires of the cable to the housing. A second step is providing a connector insert to be received in the cylindrical housing having a plurality of electrical terminals having cavities for terminating wires of the cable. In a third step the method includes extending the wires of the cable through the stem portion to be accessed through the rear backshell access. A fourth step is terminating the cable to the connector insert so that electrical sockets can be aligned with the interface axis when the insert is received and wired within the cylindrical housing. In a fifth and final step the method includes affixing a rear cover plate to the connector backshell to close the rear backshell access and contain the wires within a rear wiring space to provide interference shielding of the wires within the connector backshell.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. The electrical connector is for terminating the wires of a cable into an electrical insert positioned at an angle to the direction of the cable. The connector is used to provide a connector interface for a cable running along one surface of a bulkhead and turning at an angle through the bulkhead to a receptacle or connector adjacent the other face of the bulkhead. The electrical connector of this invention provides the connector in a minimum amount of clearance space on both sides of the bulkhead. Grounding of a shielded portion of the cable to the connector is also provided within the minimum clearance space.

Figure 1:
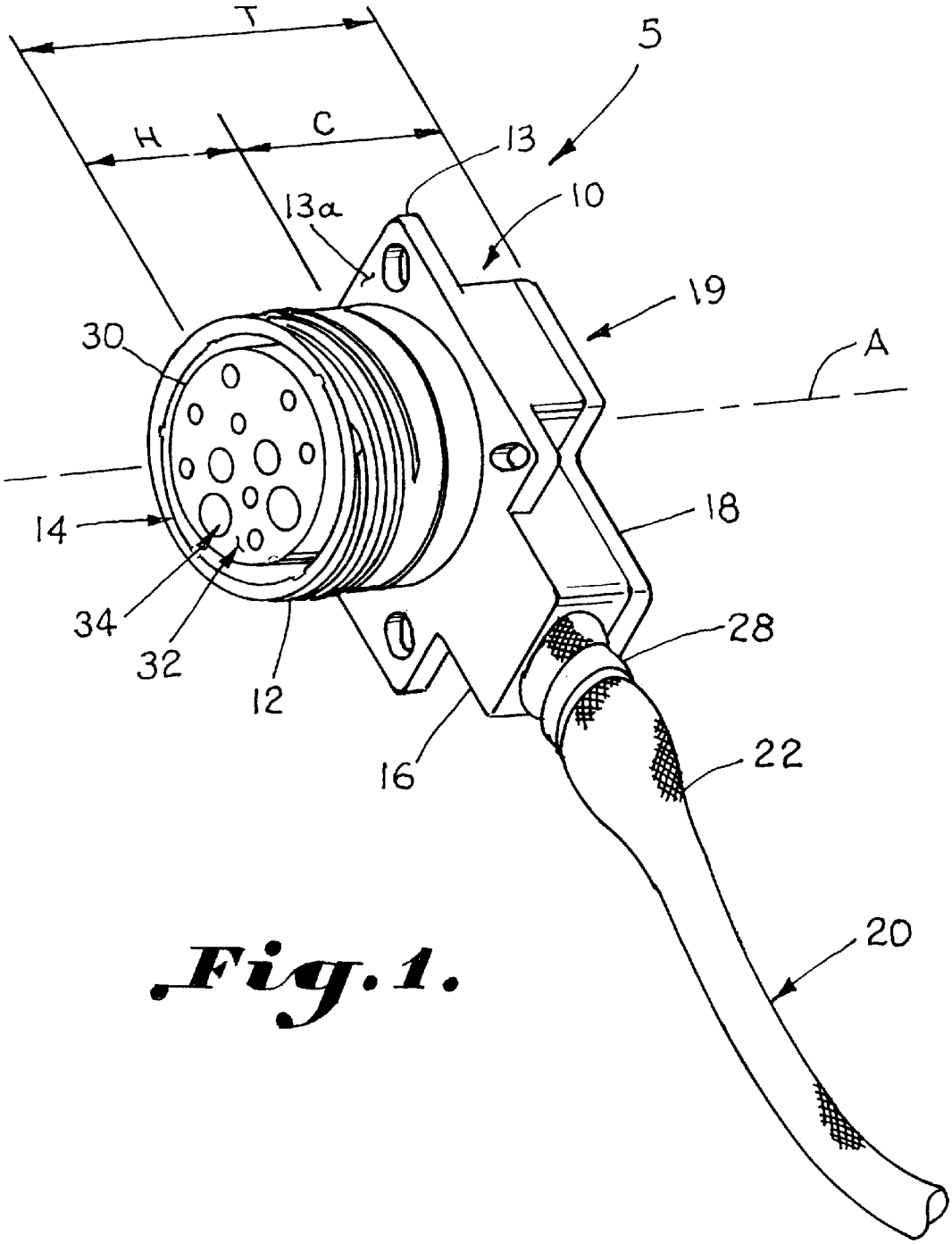
FIG. 1 is a perspective view of the electrical connector of this invention.

The invention can be best described by referring to the electrical connector and cable attachment illustrated in FIG. 1. The electrical connector 5 has a connector backshell 10 that includes a cylindrical backshell housing 12 and a hollow stem 16. A cylindrical electrical insert 30 is placed inside the cylindrical backshell housing such that a connector face 32 generally coextends with an open backshell face 14. A backshell rear cover 18 is removed to provide access to a backshell access 19 open to the rear of the backshell 10. A circular cable 20 having a conductive sheathing being a braided metallic cover 22 contains a bundle of wires 24 that enter the hollow stem 16 of the backshell. The metallic cover or conductive sheathing is affixed to the backshell using a coupling ring 28. The exposed wires of the cable enter the stem and are accessed by way of the backshell access at the rear of the backshell for terminating wires within the insert 30. Termination of wires provides electrical terminals 34 in the connector face 32 for connecting to an associated electrical interface device, such as a fail-safe plug (not shown). Electrical terminals may be either sockets, as illustrated, or pins depending on the application of the electrical connector 5.

The electrical insert 30 with its electrical terminals 34 are aligned with an interface axis A—A; being a centerline axis for the cylindrical backshell housing 12. A connector mounting flange 13 provides for attachment of the electrical connector to a supporting structure, such as a bulkhead. The connector backshell is made to limit the clearance space C between a flange face 13*a* and the bottom of the rear access cover 18. The backshell housing 12 extends from the flange face a distance H to provide space for the interface device to connect. The total thickness T, from open backshell face 14 to the bottom of the access cover 18, is made to be a minimum. For example, the electrical connector having a standard electrical insert typical in the industry can made so that the total thickness T of the electrical connector is in a range of about 1.3 inches to about 1.5 inches. An electrical insert is preferably made of an epoxy resin dielectric. A typical insert is Part No. 66345-25-20SN as manufactured by Deutsch of Hemet, Calif.

Figure 2:
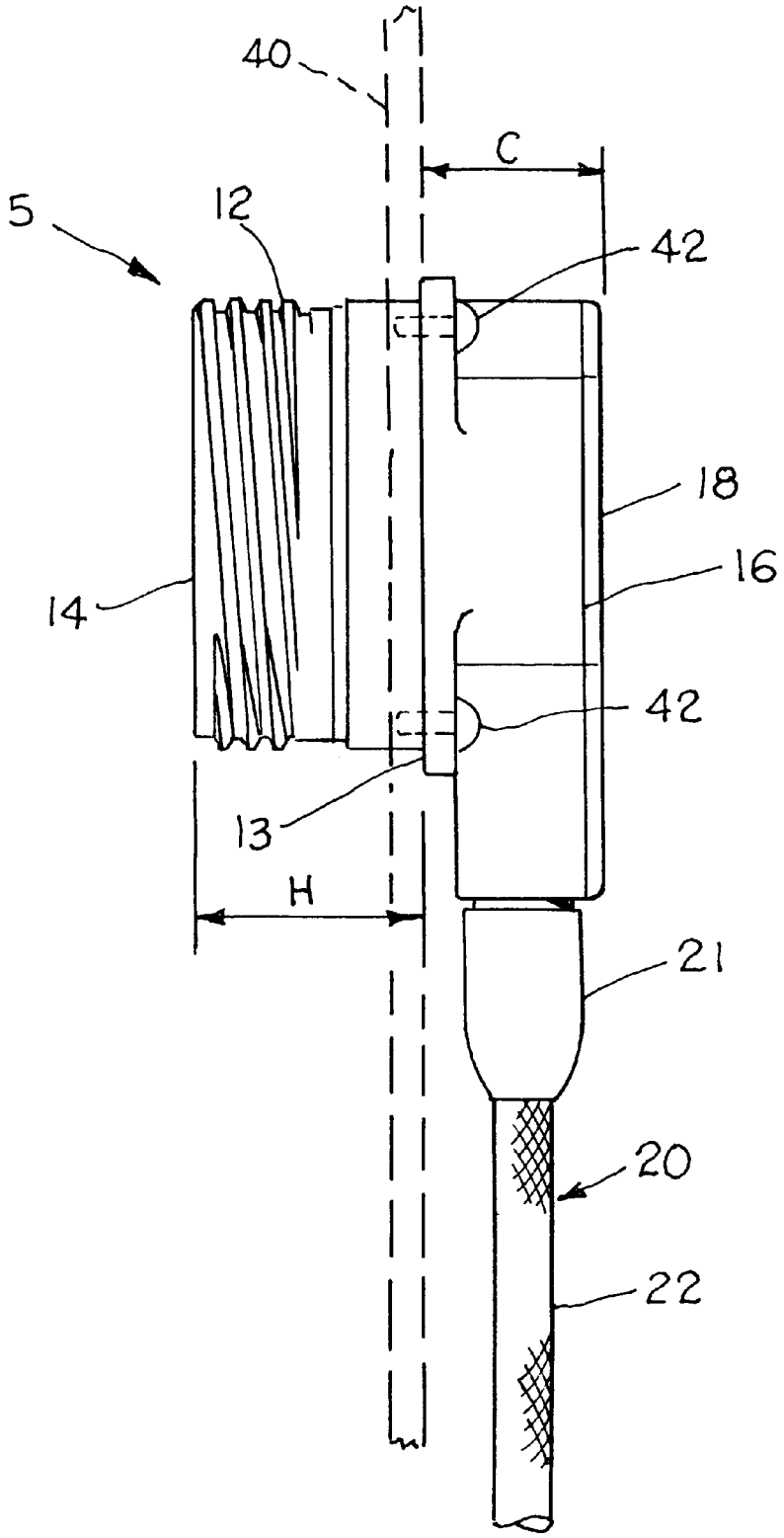
FIG. 2 is a side elevation view of the low profile connector of this invention attached to a bulkhead and illustrating a clearance dimension.

A side view of the electrical connector 5 attached to a bulkhead 40 is illustrated in FIG. 2. Fasteners 42 connect the backshell 10 at a mounting plane 40*a* to the bulkhead by way of the mounting flange 13. The connector is made to provide a minimum amount of clearance space C. The cylindrical backshell housing 12 has a connector height H adequate for an interface device to make a proper connection. The backshell is illustrated to have a threaded cylindrical backshell housing in FIG. 2. The backshell may alternately include a coupling nut within the scope of this invention. The circular electrical cable 20 with its conductive sheathing or braided metallic cover 22 interfaces the backshell within the clearance space to connect to the hollow stem 16 of the backshell. A resilient collar 21 is provided to protect and insulate the metallic cover at the interface connection. The collar is made of a plastic insulating material standard in the industry.

Figure 3:
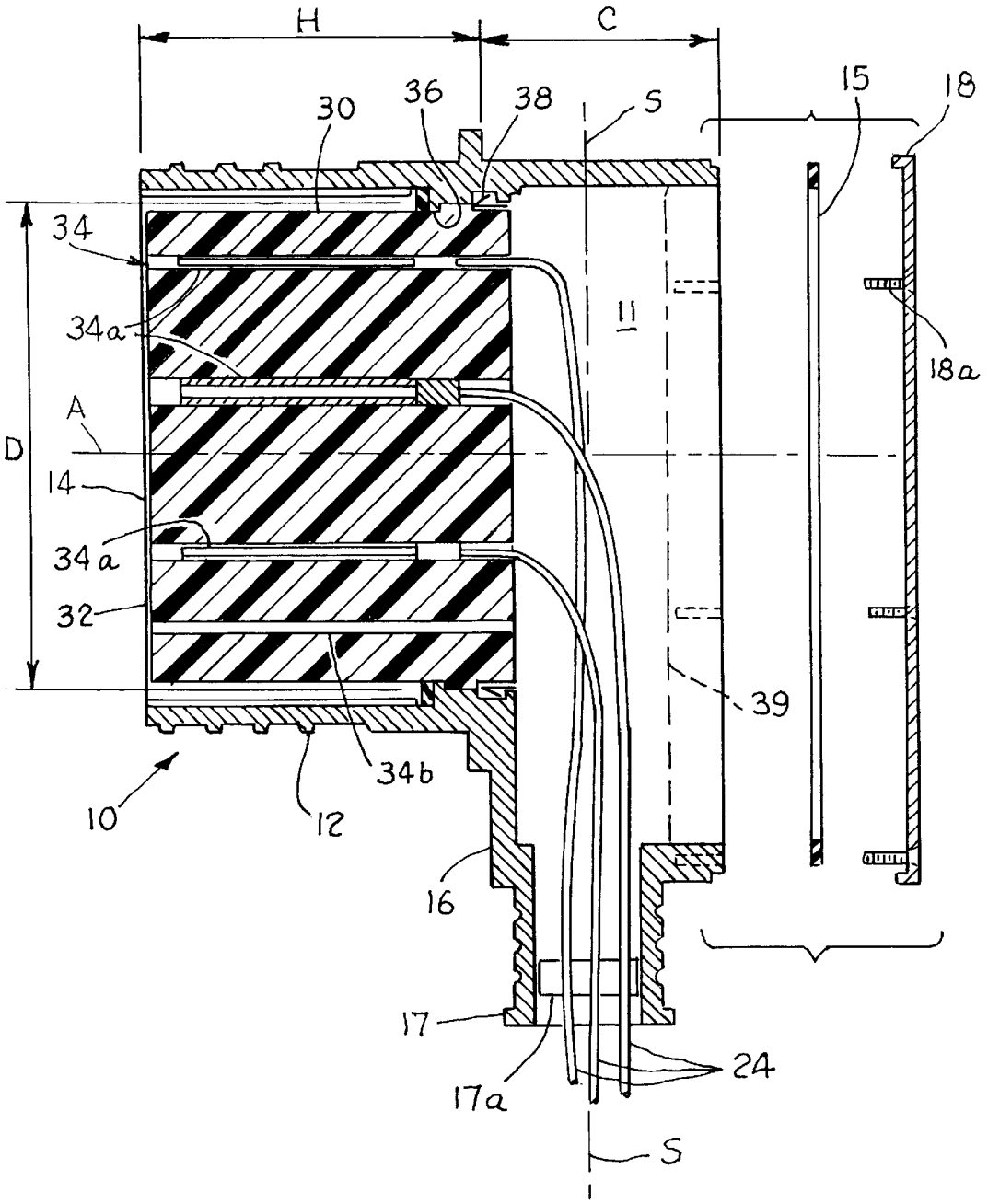
FIG. 3 is a cross-sectional view of the connector of this invention illustrating electrical wires terminated in an electrical insert carried in a backshell of the connector.

Routing of wires 24 within the connector backshell 10 and typical connections for wires to the electrical insert 30 are illustrated in the sectional view of FIG. 3. The bundle of wires enter the backshell through the neck 17 of the hollow stem 16 in the direction of a stem axis S—S and extend into the rear wiring space 11 to be accessible from the rear backshell access 19. Wires are inserted into electrical terminals 34 of the insert 30. Only a limited number of wires are illustrated for clarity in FIG. 3. A large number electrical terminals 34 are provided for in the electrical insert. For example, from 20 to 30 wires are commonly terminated in the electrical connector of this invention.

The insert can be in its final position as illustrated in FIG. 3 or may be removed from the backshell during insertion of the wires into the electrical terminals. The preferred method is to have the insert in position within the backshell housing 12 when wires are being inserted. An outer diameter of the cylindrical electrical insert 30 interfaces an inner diameter D of cylindrical backshell housing. A retainer lip 36 positions the insert along the interface axis A—A so that the connector face 32 generally coextends with the open backshell face 14. A retainer clip 38 is wedged between the backshell housing and the insert to hold the insert within the housing. Wires are turned within the rear wiring space and sockets 34*a* attached to the ends of each wire are inserted and terminated within the electrical terminals 34 of the insert parallel to the interface axis.

In an alternate embodiment the insert is made to receive pins within the terminals. Pins are aligned to be parallel with the interface axis and the ends of the pins are positioned to coextend with the open backshell face. The connector face 32 is recessed within the backshell housing for this alternate pin connector embodiment.

The number of wires being terminated is variable and depends on the use or application of the electrical connector. The insert generally contains more terminals than are needed for the particular application. Extra terminals 34*b* are filled with a filler material, usually an epoxy based material. When all wires have been terminated, an epoxy filler 39, or other suitable material, is placed around the wires within the rear wiring space. The filler helps hold the wires in position within the backshell. A rear cover 18 is affixed to the backshell by cover fasteners 18*a* to close the rear backshell access 19. A gasket 15 is placed between the cover and the backshell for sealing the interface between the cover and the backshell against any transmission of electrical interference signals.

Figure 4:
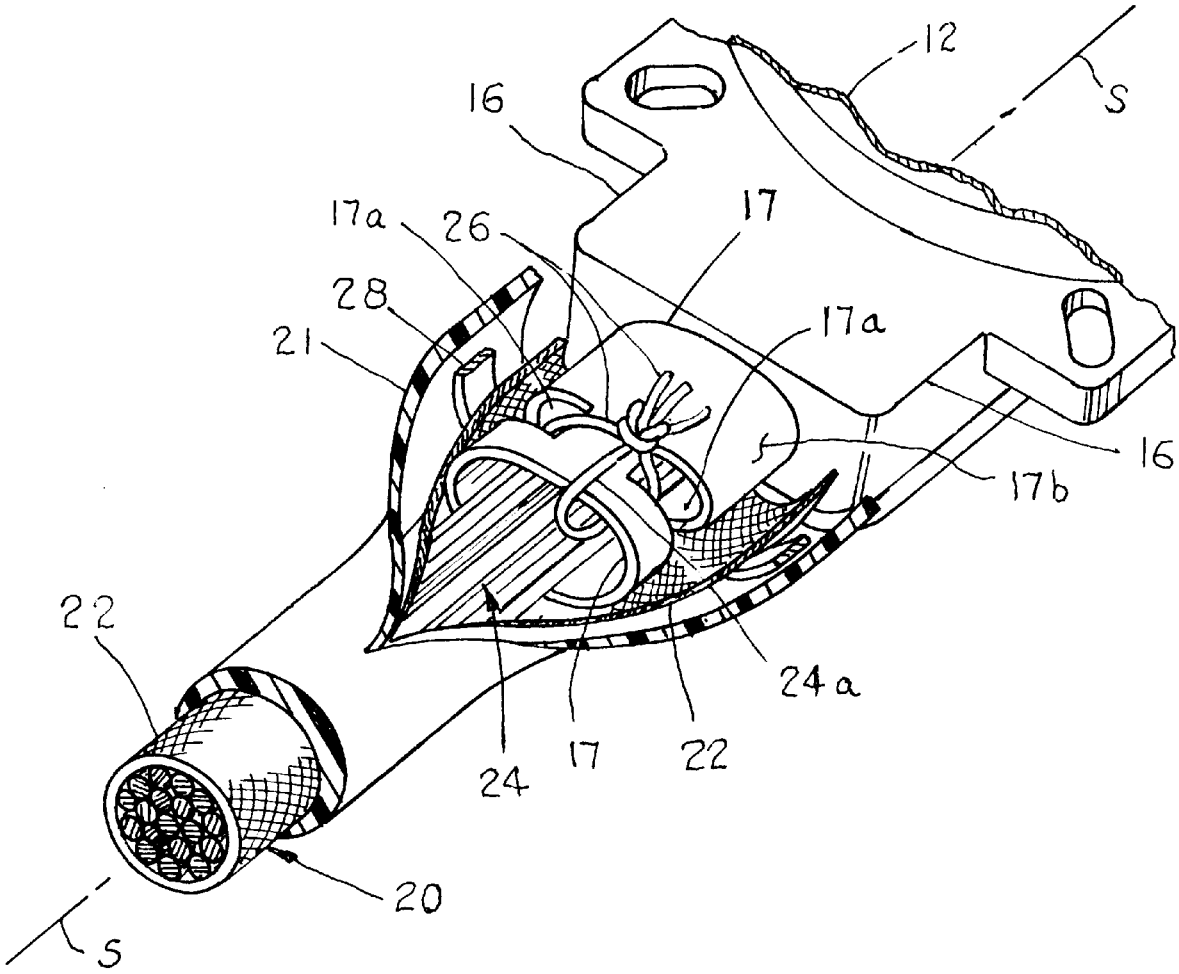
FIG. 4 is a exploded view of the a hollow stem of the connector of this invention illustrating wires passing through a neck and the attachment of a metallic cover to the neck.

The structure to provide a proper connection of the circular cable to the hollow stem of the connector backshell is essential for the electrical connector of this invention. This connection provides for a stress relief means for the wires of the cable and for shielding and grounding of the cable to the backshell. A partial perspective view of the hollow stem 16 and cable 20, showing portions removed to visualize the details of the connection, is illustrated in FIG. 4. A neck 17 extends from the hollow stem 16 along the stem axis S—S to receive the cable. Wires 24 of the cable enter the hollow portion of the hollow stem parallel to the stem axis and extend to the rear wiring space of the backshell. The wires are held within the neck by a tie cord 26 that is placed in slots 17*a* of the neck and tied around the wires and the neck to provide strain relief for the wires being terminated in the connector.

The braided metallic cover 22 to the outside of the circular cable 20 is expanded to extend over the outside surface 17*b* of the neck 17 of the hollow shaft. A coupling ring 28 is clamped around the metallic cover to hold the cover affixed to the neck. Coupling rings are known in the industry for attaching outer layers of a cable to a neck. However, the addition of the slots 17*a* in the neck of this invention improves the ability of the coupling ring to hold the metallic cover in grounded contact with the neck. A width of the ring can be made similar to a width of the slot to further improve the holding ability of the ring. A ground wire 24*a* can be placed to extend to the outside of the outside surface 17*b* of the neck to contact the metallic cover for helping to ground the cover when the coupling ring is attached. The ground wire is terminated in one of the electrical terminals 34 of the insert 30. A resilient collar 21 is placed over the outside of the metallic cover and coupling ring to help protect the connection of the cable to the connector. The collar is made of a plastic material known in the industry to shrink-fit over the cable and ring when heat is added to the collar.

While a preferred embodiment of the invention has been described using specific terms, such description is for illustrative purposes only, and it is to be understood that changes and variations may be made without departing from the spirit or scope of the following claims.

What is claimed is:

1. A low-profiled electrical connector for terminating wires of a circular electrical cable in a minimum amount of clearance space for connecting to an associated electrical interface device, said electrical connector comprising:

a low-profiled connector backshell housing which includes a cylindrical housing with an open front face normal to an interface axis of said connector backshell, and said cylindrical housing having an interior cylindrical interface wall;

a cylindrical electrical insert carried within said cylindrical housing next adjacent said interior wall, said electrical insert having a connector face generally coextending with said front face of said backshell with a plurality of electrical terminals for mating with said electrical interface device;

said backshell housing including a rear housing defined between said electrical insert and a back of said backshell housing;

a low-profiled stem integral with said backshell housing, said stem opening into said rear housing for receiving and routing said cable along a stem axis extending at an angle to said interface axis;

a rear access included in said back of said connector backshell housing having an access opening for receiving said insert there through;

said access opening being defined by a continuous peripheral wall lying in a plane generally normal to said interface axis;

a rear cover plate attached to said peripheral wall overlying said access opening for closing said access opening to provide shielding for said wires within said backshell;

a low-profile thickness for said electrical connector defined between said front face and rear cover plate of said backshell; and, a low-profile wiring space portion of said thickness defined in said rear housing of said backshell housing facilitating routing and termination of said wires of said cable to said electrical insert so that the thickness of said backshell is minimized to accommodate connection to said associated electrical interface device in a minimum amount of clearance space.

2. The connector set forth in claim 1 including a braided metallic cover surrounding said wires of said cable for shielding said wires, and a coupling ring surrounding said metallic cover securing said cover in a grounding relation said stem portion to ground said circular electrical cable to said backshell.

3. The connector set forth in claim 2 wherein said stem portion includes a neck with at least one open slot and a tie extending through said slot to grip said wires to mechanically connect said wires and electrical cable to said neck of said connector backshell and provide mechanical strain relief to said cable.

4. The connector set forth in claim 1 including a rear wiring space defined within said connector backshell behind said electrical insert and said rear access cover for routing and turning said wires when when terminated to said electrical insert.

5. The connector set forth in claim 1 wherein said interface axis is at a right angle of 90 degrees to said stem axis.

6. The connector set forth in claim 1 wherein said electrical insert includes a plurality of sockets for terminating contacts of said plurality of electrical terminals within said insert.

7. The connector set forth in claim 6 wherein said interior interface wall has an inner diameter for interfacing an outer diameter of said cylindrical electrical insert and a retainer lip for positioning said insert within said housing to align said plurality of terminals with said interface axis.

8. The connector set forth in claim 7 including a retainer clip wedged between said interior interface wall and said electrical insert for holding said insert within said housing.

9. The connector set forth in claim 1 including a gasket for sealing the interface between said rear cover and said backshell peripheral wall against any electrical interference signals.

10. The connector of claim 1 wherein said low-profile thickness is in a range of about 1.3 to 1.5 inches.

11. The connector of claim 1 wherein said stem includes a low-profiled oval stem which fits within the thickness dimension of said low-profile wiring space portion.

12. The connector of claim 11 including a cable cover surrounding said wires of said cable for protecting said wires, and wherein said oval stem includes raised ribs on an exterior surface for gripping said cover to assist in retaining said cover.

13. The connector set forth in claim 11 wherein said oval stem includes a at least one open slot and a binding element extending through said slot to grip and mechanically connect said wires and electrical cable to said oval stem providing mechanical strain relief to said cable.

14. The connector of claim 1 including an insulating filler material filled around said wires of said cable within said rear wiring space filling said wiring space for holding and protecting said wires within said backshell.

15. The connector of claim 1 wherein said electrical insert consist of a one-piece insert carried within said backshell.

16. The connector of claim 1 wherein said backshell consists of two-pieces which includes said backshell housing and said rear cover.

17. A low-profile electrical connector assembly for terminating wires of a shielded cable to an associated electrical interface device at an angle to the direction of said cable, said assembly comprising:

a connector backshell which includes:

a backshell housing including a cylindrical housing with an interface axis disposed at said angle, and said cylindrical housing having an open front face perpendicular to said interface axis, a rear access opening included in a rear of said backshell housing to accommodate the termination of said wires to said connector insert, a rear access cover affixed to said backshell housing overlying and closing said rear access opening, a low-profile thickness defined between said front face opening of said backshell housing and the back of said rear access cover providing use of said electrical connector in a minimum space, and a hollow stem having a low-profiled neck facilitating routing of said cable within said low-profile thickness of said backshell housing along a stem axis extending at said angle to said interface axis;

an electrical connector insert carried within said backshell housing having a connector face generally coextending with said open backshell face and having a plurality of terminals for terminating contacts associated with said wires;

a rear wiring space of said backshell defined between said connector insert and said rear access back cover for routing and termination of said wires within said backshell;

a mount for affixing said backshell to an interface support; and, said low-profile thickness of said backshell including a low-profiled clearance portion defined between said backshell mount and said rear access cover facilitating mounting of said backshell connector in a minimum amount of clearance space.

18. The connector set forth in claim 17 wherein said cylindrical backshell housing has an inner diameter for interfacing an outer diameter of said cylindrical connector insert and a retainer lip for positioning said insert within said housing when inserted through said rear backshell access to coexist with said open backshell face and to align said plurality of sockets with said interface axis.

19. The connector set forth in claim 17 including a retainer clip wedged between said cylindrical backshell housing and said connector insert by way of said rear backshell access for holding said connector insert within said housing.

20. The connector set forth in claim 17 wherein said neck portion of said hollow stem has a slot on each opposite side for receiving a cord tie to mechanically connect and bundle said wires to said stem of said backshell.

21. The connector set forth in claim 20 including a resilient collar exterior to said cable and said coupling ring for closing and insulating the connection between said cable and said backshell.

22. The connector set forth in claim 17 including a gasket for sealing the interface between said rear access cover and said backshell against any electrical interference signal emissions.

23. The connector set forth in claim 17 including an epoxy filler placed around said wires of said cable within said rear wiring space to fill said wiring space for holding and protecting said wires within said backshell.

24. The connector set forth in claim 17 wherein said angle is such that said interface axis is at a right angle being 90 degrees to said stem axis.

25. The connector of claim 17 including a coupling band for clamping a metallic cover of said shielded cable into grounding contact with said neck portion and for providing a shielded attachment of said cable to said backshell.

26. The connector of claim 17 wherein said low-profile thickness is in a range of about 1.3 to 1.5 inches.

27. The connector of claim 17 wherein said electrical insert consist of a one-piece insert carried within said backshell.

28. The connector of claim 17 wherein said backshell consists of two-pieces which includes said backshell housing and said rear cover.

29. A low profile electrical connector having a minimum thickness relative to a mounting plane for terminating and connecting wires of an electrical cable in a minimum clearance space, said electrical connector adapted for connection to an associated electrical interface device in said clearance space, said electrical connector comprising:

a low-profiled backshell having a backshell housing including a front face opening and a rear access opening;

said backshell housing including a insert space for receiving an electrical insert, said insert space extending generally from said front face opening and terminating at a rear wiring space;

a one piece electrical insert carried within said insert space within said backshell housing having a plurality of electrical terminals to which the wires of said cable are terminated, and said electrical terminals being arranged to mate with corresponding terminals of said electrical interface device;

said rear wiring space extending generally from said electrical insert to said rear access opening;

said housing including a reduced profile stem integral with said backshell housing opening into said rear wiring space for receiving and routing the wires of said electrical connector for termination to said electrical insert; and a removable rear cover plate attached to said backshell housing for closing said rear access opening and for providing access for termination of said cable wires when removed.

30. The connector of claim 29 including a nonconductive gasket disposed between said rear cover and said backshell housing when affixed to enclose said access opening.

31. The connector of claim 29 including an insulating filler material generally filling said wiring space and encapsulating the wires of said cable within said wiring space.

32. The connector of claim 29 wherein said reduced stem has an oval configuration to provide a low profiled entrance into said wiring space.

33. The connector of claim 32 including at least one open slot formed in said oval stem, and a binding element received in said slot to grip and mechanically bind the wires of said cable to said stem to provide mechanical strain relief.

34. The connector of claim 29 wherein said backshell housing includes a mounting flange for affixing said connector to an associated mounting structure at said mounting plane, and said minimum clearance space being defined between a front face of said mounting flange and said rear access cover.

35. A cable assembly having a low profile electrical connector for connecting a cable assembly to a interface device at an interface plane comprising:

an electrical transmission cable having a plurality of electrical signal transmitting wires; and a connector backshell comprising an integral backshell housing which includes:

a front connector face opening, an electrical insert space a one-piece electrical insert carried in said insert space, said signal wires being terminated to terminals of said electrical insert, a rear wiring space, a rear access opening providing access to said rear wiring space, a reduced stem providing an entrance into said rear wiring space routing the wires of said cable through said wiring space for termination to said electrical insert, an insulating filler material encapsulating the wires of said cable within said rear wiring space, and a wall mount for mounting said backshell housing to an associated structure at a mounting plane for mating with said electrical interface device.

36. The connector of claim 35 including a nonconductive gasket disposed between said rear cover and said backshell housing when said cover is affixed over said access opening.

37. The connector of claim 36 wherein said reduced stem has an oval configuration to provide a low profiled entrance into said wiring space.

38. The connector of claim 35 wherein said reduced stem has an oval configuration to provide a low profiled entrance into said wiring space.

39. The connector of claim 38 including at least one open slot formed in said oval stem, and a binding element received in said slot to grip and mechanically bind the wires of said cable to said stem to provide mechanical strain relief.

40. The connector of claim 35 including at least one open slot formed in said reduced stem, and a binding element received in said slot to grip and mechanically bind the wires of said cable to said stem to provide mechanical strain relief.

* * * * *